US005119261A

United States Patent [19]

Sonntagbauer

[11] Patent Number: 5,119,261

[45] Date of Patent: Jun. 2, 1992

[54] CIRCUIT ARRANGEMENT FOR SWITCHING CURRENT TO THYRISTORS

[75] Inventor: Ernst Sonntagbauer, Vienna, Austria

[73] Assignee: Elin-Union Aktiengesellschaft fur Elektrische Industrie, Vienna, Austria

[21] Appl. No.: 474,801

[22] PCT Filed: Dec. 13, 1988

[86] PCT No.: PCT/AT88/00109

§ 371 Date: Jun. 11, 1990

§ 102(e) Date: Jun. 11, 1990

[87] PCT Pub. No.: WO89/06043

PCT Pub. Date: Jun. 29, 1989

[30] Foreign Application Priority Data

Dec. 18, 1987 [AT] Austria ..... 3349/87

[51] Int. Cl.[5] ..... H01H 9/54

[52] U.S. Cl. ..... 361/2; 361/3; 361/8

[58] Field of Search ..... 361/2, 3, 8, 11, 13, 361/9; 200/146 R, 1 B, 1 A

[56] References Cited

U.S. PATENT DOCUMENTS 4,525,762 6/1985 Norris ..... 361/13

*Primary Examiner*—A. D. Pellinen
*Assistant Examiner*—S. Jackson
*Attorney, Agent, or Firm*—Sandler, Greenblum & Bernstein

[57] ABSTRACT

The invention relates to a circuit arrangement for switching current from a contact to a thyristor connected in parallel to the contact. In the inventive circuit arrangement ohmic resistances (7, 8, 9, 10) are connected in parallel to the contact (1), whereby each ohmic resistance (7, 8, 9, 10) can be individually disconnected by means of a delayed-opening contact (3, 4, 5, 6) and the disconnection times are staggered. In this manner, it is possible to accomplish stepwise current switching and thus reliably prevent arcing at the contact (1).

5 Claims, 1 Drawing Sheet

CIRCUIT ARRANGEMENT FOR SWITCHING CURRENT TO THYRISTORS

Figure 1:
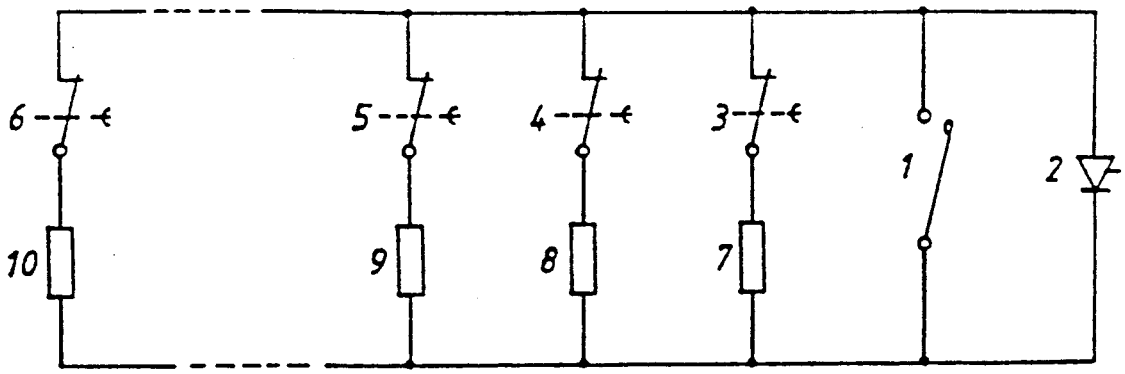

The invention relates to a circuit arrangement for switching current from a contact to a thyristor, whereby the thyristor is connected in parallel to the contact.

Circuit arrangements are known, in which the switching of current to the thyristor is effected by connecting inductances to the thyristor circuit.

The disadvantage thereby results that arcing occurs at the contact.

The object of the invention is to provide an arrangement by means of which arcing is prevented upon opening of the contact.

The object is achieved by the invention.

This is characterized in that at least one, preferably several ohmic resistances 7, 8, 9, 10 are connected in parallel to the contact, and that each resistance is individually disconnectable by means of a delayed-opening contact 3, 4, 5, 6, whereby the disconnection times are staggered, and that the voltage drop at the contact 1 and at the delayed-opening contacts 3, 4, 5, 6, respectively, is smaller than 30 volt.

By the circuit arrangement according to the invention it is possible to accomplish stepwise switching of the current. The advantage thereby is that arcing and thus burning at the contact is reliably prevented.

A further development of the invention consists in that, in place of the contact and the ohmic resistances connected in parallel, there is provided a movable laminated contact piece which consists of individual laminations of electrically conductive material and insulated from one another, whereby these laminations are mutually displaceable relative to each other in the lifting direction of the contact piece and preferably comprise different resistance values, and that during the opening operation the laminations sequentially lift off from one or several opposite contact pieces.

In this manner, it is possible to switch very high currents and to finely grade the increase of the contact resistance.

The feature of a further development of the invention consists in that the stationary contact piece opposite the movable laminated contact piece consists of individual laminations of electrically conductive material and insulated from one another, whereby the resistance values of these laminations are preferably variable. The advantage results therefrom that the increase of the contact resistance is graduatable in a substantially more exact manner.

A further development of the invention consists in that the stationary contact piece opposite the movable laminated contact piece consists of individual laminations of electrically conductive material and insulated from one another, whereby the resistance values of the laminations are equal, and that each two adjacent laminations are conductively connected together by means of a separate ohmic resistance, and that the resistance values of the ohmic resistances are preferably different.

It is thereby advantageous that the circuit arrangement can be optimally construed by means of the separate ohmic resistances and by means of the large possibility of variation thereof with the most diverse resistance values.

According to an embodiment of the invention there is provided as a sliding contact, in place of the contact and the ohmic resistances connected in parallel, a movable or stationary lamination of electrically conductive material structured to be wedge-shaped in the lifting direction, the cross section of the lamination decreasing toward the contact piece or the contact pieces.

The advantage thereby is that the increase of the contact resistance during the switching-off operation is no longer stepwise, but continuously effected.

The invention will now be described in still greater detail with reference to a circuit diagram.

When current is switched from contacts to thyristors connected in parallel thereto, the current rise in the thyristors should not exceed an upper value of approximately 100 ampere per microsecond. It is customary that this current rise is maintained at a permissible value by switching inductances to the thyristor branch. This has the disadvantage that the voltage drop at the opening contact is so high that an arc will develop.

This disadvantage is precluded in that the voltage drop at the contact is stepwise or continuously increased by means of the forward voltage of the thyristor, so that switching is effected slowly and not abruptly.

The FIG. 1 shows the parallel connection of a contact 1 with a thyristor 2 and several ohmic resistances 7, 8, 9, 10, which are in each case individually disconnectable by means of delayed-opening contacts 3, 4, 5, 6.

Prior to switching, the contact 1 as well as the delayed-opening contacts 3, 4, 5, 6 are closed, the thyristor 2 being in the nonconducting switching condition.

The switching operation is initiated with the supply of a triggering pulse to the control electrode of the thyristor 2, such triggering pulse converting the thyristor to the conducting switching condition. The anode-cathode path is of low resistance. Immediately thereafter the contact 1 is opened. The contacts 3, 4, 5, 6 are closed for the time being.

At this moment of time the circuit corresponds to a parallel connection of the thyristor 2 with the ohmic resistances 7, 8, 9, 10.

The current to be switched flows, inversely proportional to the resistance values, for the greater part through the ohmic resistances 7, 8, 9, 10, the residual current flowing through the thyristor 2. Now the contact 3 opens, whereby only the ohmic resistances 8, 9 and 10 are connected in parallel to the thyristor 2. As a result of the increased total resistance value of the parallel connection, there now flows a proportion greater than hitherto of the total current through the thyristor 2, a reduced proportion flowing through the resistances.

After the contacts 4 and 5 have opened, only the ohmic resistance 10 is connected in parallel to the thyristor 2. This again increased resistance value of the parallel connection effects a further increase of current take-over by the thyristor 2.

At the end of the switching operation the contact 6 opens, whereby the ohmic resistance 10 is disconnected. The entire current now flows through the thyristor 2.

By the selection of suitable material and appropriate dimensioning of the ohmic resistances 7, 8, 9, 10, as well as by matching the resistance values with the disconnection times of the delayed-opening contacts 3, 4, 5, 6, the switching arrangement can be optimally adjusted for every type of thyristor. For dimensioning the ohmic resistances it is noteworthy that the voltage drop occurring at the contact 1 or at the delayed-opening contacts 3, 4, 5, 6, respectively, remains below the value at which arcing occurs. This minimum voltage is approximately 30 volt.

Figure 2:
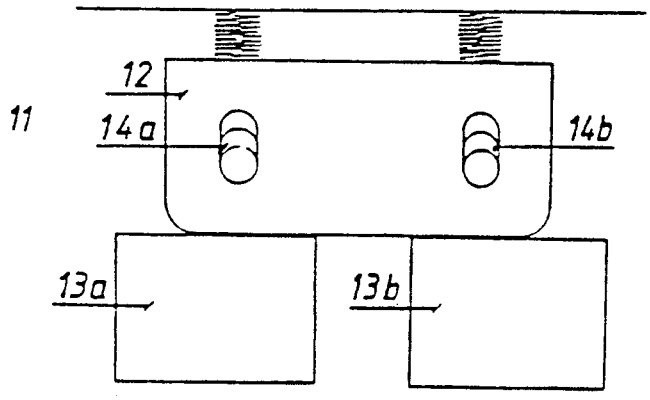
Figure 3:
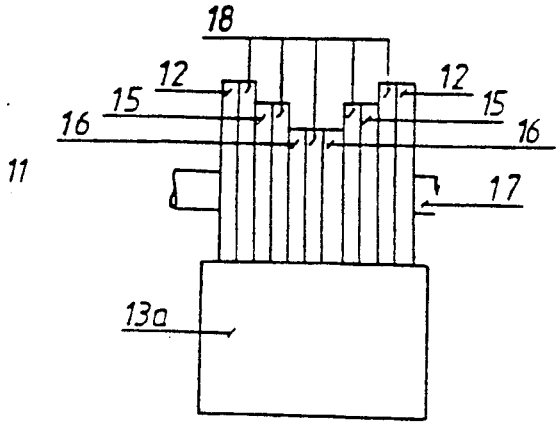

The further development of the invention as a laminated contact piece will be considered in greater detail with reference to FIGS. 2 and 3. FIG. 2 shows in side view a lateral lamination 12 of a movable contact piece 11 and, opposite thereto, two stationary contact pieces 13*a*, 13*b*.

At two oblong holes 14*a*, 14*b* of the lateral lamination 12 it is perceivable that the laminations located behind the latter are provided with oblong holes of different length or with round holes. Of the two semicircular arches bounding respective oblong holes or round holes, those semicircular arches on the side facing the stationary contact piece are in alignment.

In the closed switching condition the end faces of all laminations 12, 15, 16 bear upon both the stationary contact pieces 13*a*, 13*b*.

FIG. 3 shows the front view of the movable contact piece 11 and the stationary contact piece 13*a*. By using insulating intermediate layers 18, the individual laminations 12, 15, 16 are loosely mutually displaceable relative to one another. The individual layers 12, 15, 16 are held in position by means of a mounting bolt 17. An insulating tube not illustrated in the drawing is slipped over the mounting bolt.

During the circuit-breaking operation, the mounting bolt 17 is moved by a switching mechanism in the direction facing away from the stationary contact pieces 13*a*, 13*b*.

In this manner, the laminations 16 provided with round holes or the shortest oblong holes are the first to be lifted off. The current is thus divided among the laminations 12, 15 still bearing upon the stationary contact, whereby the contact resistance and the voltage drop occurring at the contact are increased. With progressive switching-off movement the laminations 15 are the next to lift off, thus causing a further increase of contact resistance and voltage drop at the contact.

Finally, the laminations 12 with the longest oblong holes are lifted from the stationary contact pieces 3*a*, 3*b* and brought by the switching mechanism into the end position of the switching operation.

By appropriate material selection and dimensioning of the laminations the ohmic resistance of the contact piece can be optimally adapted to the respective specific requirements. There is again to be considered that the occurring voltage drop between the stationary contact pieces 13*a*, 13*b* and the respective lifting-off lamination of the movable contact piece 11 is smaller than 30 volt.

We claim:

1. Circuit arrangement for switching current from a contact to a thyristor, whereby said thyristor is connected in parallel to said contact, wherein at least two ohmic resistances are connected in parallel to said contact, and wherein each said resistance is individually disconnectable by means of a delayed-opening contact, whereby the disconnection times are staggered, and the voltage drop at said contact and at said delayed-opening contacts, respectively, is less than 30 volts.

2. Circuit arrangement according to claim 1, wherein the assembly of said contact and said ohmic resistances together with said delayed-opening contacts is structured as a movable laminated contact piece, which comprises individual laminations of electrically conductive material, said individual laminations being insulated from each other, whereby said laminations are mutually displaceable relative to each other in a lifting direction of said contact piece, said laminations preferably comprising different resistance values, such that during the opening operation, said laminations sequentially lift off from one or several opposite stationary contact pieces.

3. Circuit arrangement according to claim 2, wherein each said stationary contact piece is located opposite said movable laminated contact piece, each said stationary contact piece comprising individual laminations of electrically conductive material which are insulated from one another, whereby the resistance values of said laminations of said contact piece are different.

4. Circuit arrangement according to claim 2, wherein each said stationary contact piece opposite said movable laminated contact piece comprises individual laminations of electrically conductive material which are insulated from one another, whereby the resistance values of said laminations of each said stationary contact piece are equal, and each two adjacent laminations are conductively connected together by means of a separate ohmic resistance, the resistance values of said separate ohmic resistances being different.

5. Circuit arrangement according to claim 1, wherein the assembly of said contact and said ohmic resistances together with said delayed-opening contacts is structured as a movable or stationary sliding contact in the form of a lamination of electrically conductive material an is wedge-shaped in the lifting direction, the cross section of said lamination decreasing toward at least one opposite contact piece.

* * * * *